US007581726B2

(12) United States Patent
Seiler

(10) Patent No.: US 7,581,726 B2
(45) Date of Patent: Sep. 1, 2009

(54) DEVICE AND METHOD FOR COLLECTING SUCCESSIVELY FED FLAT OBJECTS

(75) Inventor: Reinhard Seiler, Aindling (DE)

(73) Assignee: Bowe Systec AG, Augsburg (DE)

( * ) Notice: Subject to any disclaimer, the term of this patent is extended or adjusted under 35 U.S.C. 154(b) by 0 days.

(21) Appl. No.: 11/326,251

(22) Filed: Jan. 5, 2006

(65) Prior Publication Data

US 2006/0157920 A1 Jul. 20, 2006

Related U.S. Application Data

(63) Continuation of application No. PCT/EP2004/008213, filed on Jul. 23, 2004.

(30) Foreign Application Priority Data

Aug. 2, 2003 (DE) ..... 103 35 418

(51) Int. Cl.
*B65H 83/00* (2006.01)

(52) U.S. Cl. ..... 271/3.01; 271/188

(58) Field of Classification Search ..... 271/3.01, 271/3.02, 3.04, 272, 3.03, 198, 199, 161, 271/188, 209

See application file for complete search history.

(56) References Cited

U.S. PATENT DOCUMENTS

| | | | | |
|---|---|---|---|---|
| 3,785,256 A | | 1/1974 | Nikkel | |
| 4,145,038 A | * | 3/1979 | Mol | 270/58.21 |
| 4,252,483 A | * | 2/1981 | Pfaffle | 414/796.1 |
| 4,500,241 A | * | 2/1985 | Peters et al. | 412/37 |
| 4,700,939 A | * | 10/1987 | Hathaway | 270/39.02 |
| 4,743,319 A | * | 5/1988 | Ramcke | 156/64 |
| 4,925,173 A | | 5/1990 | Lindblom et al. | |
| 5,342,038 A | | 8/1994 | Suter | |

FOREIGN PATENT DOCUMENTS

| | | |
|---|---|---|
| DE | 34 10 862 | 3/1984 |
| DE | 34 10 862 | 10/1985 |
| DE | 37 25 225 | 7/1987 |
| EP | 0 277 719 | 8/1988 |
| EP | 0 455 494 | 11/1991 |
| EP | 0 528 493 | 2/1993 |

OTHER PUBLICATIONS

The definition of the term "deflect" in Webster's New International Dictionary, Second Edition Unabridged (1957) at p. 688.*

* cited by examiner

*Primary Examiner*—Patrick H Mackey
*Assistant Examiner*—Thomas A Morrison
(74) *Attorney, Agent, or Firm*—Thomas, Kayden, Horstemeyer & Risley

(57) ABSTRACT

The invention relates to a device and a method for collecting successively fed flat objects, in particular sheets. The device contains a blocker having at least one movable blocking element for stopping and subsequently releasing a certain number of objects fed, wherein the blocking element is a rotational body rotatable by a motor around its middle axis which, at its exterior periphery, has at least one reception for stopping the front edges of the objects fed in an idle position of the rotational body and for its deflection when turning the rotational body, and wherein at least one transport element for advancing the objects deflected when turning the rotational body is associated to the rotational body.

8 Claims, 6 Drawing Sheets

DEVICE AND METHOD FOR COLLECTING SUCCESSIVELY FED FLAT OBJECTS

CROSS-REFERENCE TO RELATED APPLICATION

This application is a continuation of copending International Application No. PCT/EP2004/008213, filed Jul. 23, 2004, which designated the United States and was not published in English, which PCT application claims priority to German application number 10335418.2 filed on Aug. 2, 2003, and is incorporated herein by reference in its entirety.

BACKGROUND OF THE INVENTION

1. Field of the Invention

The invention refers to a device and a method for collecting successively fed flat objects, in particular sheets, according to the preamble of claim 1 or 13.

2. Description of Prior Art

Collecting means of the type mentioned above are, for example, used in paper handling apparatuses for putting together successively fed sheets to form desired groups of sheets or sheet stacks. Thus, sheets which are for example provided by cutting means and/or sheet feeding means and then advanced subsequently individually, in a shingled or even pre-collected manner are put together to form a sheet stack which can then be transported for further processing to a downstream processing station, such as, for example, folding means, enveloping means or the like.

EP 0 528 493 B1 teaches a generic device for collecting a number of sheets fed one after the other to form stacks. Here, the individual sheets fed one after the other are transported to a stop between an upper and a lower endless transport belt. This includes a stop gate which may be rotated between an upper pivot position where the sheets are slowed at the stop gate and put together to form a stack, and a lower pivot position for releasing the stack formed. With such a collecting device, however, a collected group of sheets must at first be transported completely past the stop gate rotated downwards before it can be rotated upwards again for collecting the next group of sheets. A relatively large gap must be provided between the last sheet of a previous group of sheets and the first sheet of a subsequent group of sheets in order to ensure proper removal of the collected group of sheets. Because the feeders arranged in an upstream transport direction of the collecting device usually allow considerably higher conveying rates than the collecting device, suitable measures must be provided to be able to interrupt or delay the sheet feed to the collecting unit correspondingly. This, however, entails considerable driving and controlling complexity. Additionally, the throughput of a paper handling apparatus and thus of its clock performance is limited by such a collecting device.

EP 0 455 494 B1 discloses means for collecting sheets which comprises two separate gathering units arranged one above the other for improving the throughput. Each of the two gathering units contains upper and lower endless transport belts guided over idler pulleys, between which a collecting station for producing a desired stack of sheets is formed. For collecting the sheets fed one after the other to a gathering unit, opposing bearing rolls are arranged on the respective driving shafts of the, in a transport direction, back idler pulleys, wherein these rolls may be stopped for forming a stack of sheets and be released again to rotate for removing the collected stack of sheets. Between a sheet feeder and the two gathering units arranged one above the other, redirecting means is provided by means of which the sheets fed to the collecting means may either be directed to the upper or the lower gathering unit. Thus, too long a stop of the sheet feeder during normal operation can be avoided. However, in this well-known collecting device, too, a gap must be provided between the last sheet of a previous group and the first sheet of a subsequent group in order for the redirecting means to rotate. Furthermore, the structural complexity and the space requirements are increased by the two-storied design of the gathering unit.

SUMMARY OF THE INVENTION

It is an object of the invention to provide a device and a method allowing a quick collection of flat objects and their removal without considerably delaying the run time.

In accordance with a first aspect, the present invention provides a device for collecting flat objects, particularly sheets, fed successively in an intake plane, wherein the device includes blocking means containing at least one moveable blocking element for stopping and subsequently releasing a certain number of objects fed, wherein the blocking element is a rotational body rotatable by a motor around its middle axis which has at its exterior periphery at least one reception formed by a recess for stopping the striking front edges of the objects fed in an idle position of the rotational body and for a deflection thereof when rotating the rotational body, and wherein at least one transport element for advancing the collected objects deflected when rotating the rotational body is associated to the rotational body, characterized in that the middle axis of the rotational body and the intake plane are essentially arranged in a common plane, and the recess is formed such that it is symmetrical relative to the intake plane in the idle position of the rotational body.

In accordance with a second aspect, the present invention provides a method for collecting flat objects, particularly sheets, fed successively in an intake plane, wherein a certain number of objects fed are stopped by blocking their front edges at a blocking element arranged in a collecting position and then released by moving the blocking element, wherein the front edges of the objects are stopped in a reception formed by a recess of a rotational body rotatable around a middle axis and the rotational body is rotated by a predetermined rotational angle after having reached a desired collecting amount, wherein the front edges of the objects collected are deflected for being removed from a feeding plane and at the same time an empty reception is turned to the collecting position, characterized in that the middle axis of the rotational body and the intake plane are essentially arranged in a common plane, and the recess is formed such that it is symmetrical relative to the intake plane in the idle position of the rotational body.

A considerable advantage of the invention is that collecting the next group may be started without forming a gap, already during removal of the previous group of flat objects. By turning the rotational body, not only may the desired number of collected sheets be deflected for a quick removal from the feeding plane, but at the same time a new reception for the objects of the next group may be moved to a collecting position. The turning of the rotational body may be controlled by a suitable positioning drive in dependence on sensors which each detect a last object of a group to be collected. As soon as the end of a respective group is reached, the rotational body forming the blocking element is turned by a certain angle. Thus, on the one hand the front edge of the completed stack is moved to a removal unit and on the other hand an empty reception is turned towards the feeder. This principle allows already starting to collect the objects for the next stack during the removal of a completed collected stack. Thus, an increased throughput at very short cycle times is possible. Since a new reception for collecting the next group is available relatively quickly still during the removal of the previous group, no gap is required between the last sheet of the previous group and the first sheet of a subsequent one. A certain distance between the two front edges of successive sheets is sufficient to ensure proper transport and separation.

In a particularly suitable embodiment of the invention, the blocking means is implemented such that the rotational body may be turned in both turning directions and may deflect the flat objects optionally in an upward or downward direction. Thus, collecting and advancing objects shingled in an ascending and descending manner is possible. When the objects fed to the collecting means are, for example, shingled in an ascending manner, that is the front edge of a subsequent object is on top of the previous sheet, the rotational body may be turned counterclockwise. When the objects fed to the collecting means, however, are shingled in a descending manner, that is the front edge of the subsequent object is below the previous object, the rotational body may be turned clockwise. Thus, a simple and easy adjustment to the optional collection from above or below is made possible.

The rotational body may comprise one or several receptions or collecting chambers distributed over the periphery for the front edges of the objects to be collected. With only one reception, the rotational body has to be turned by 360°, whereas a correspondingly smaller rotational angle is sufficient with several receptions to move the completed collected stack into a removal unit and to turn an empty reception to the feeding plane.

BRIEF DESCRIPTION OF THE DRAWINGS

Further characteristics and advantages of the invention will result from the subsequent description of a preferred embodiment referring to the drawings, in which.

DESCRIPTION OF PREFERRED EMBODIMENTS

Figure 1:
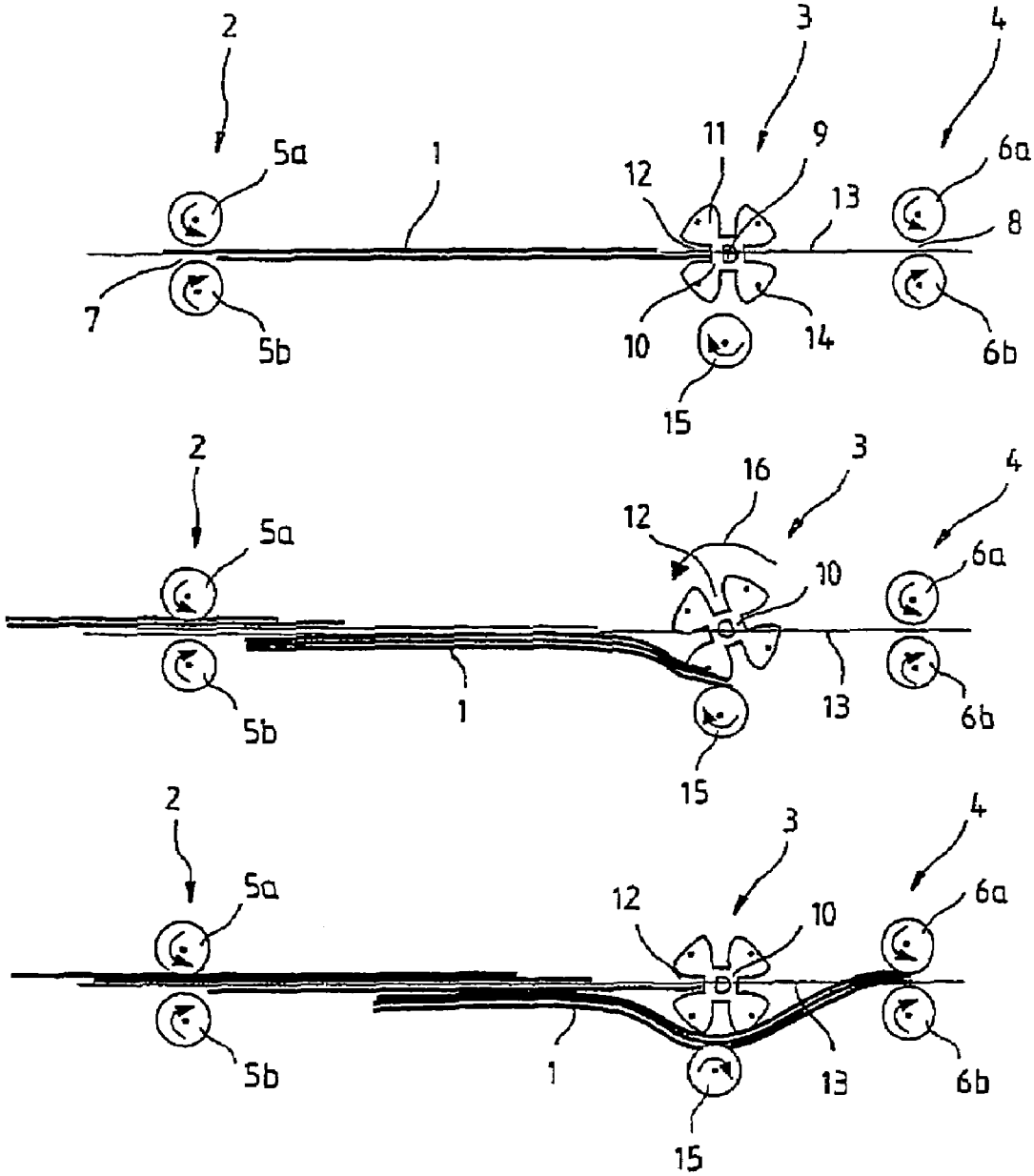
FIG. 1 is a schematic illustration of a collecting device comprising a first embodiment of blocking means in different positions.

The flow principle of an inventive device for collecting a certain number of successively fed sheets 1 to form a desired stack of sheets is shown in FIG. 1. The collecting device illustrated schematically in different positions contains first conveying means 2 for transporting the successive sheets 1, blocking means 3 for putting together the sheets provided by the conveying means 2 to form the desired stack of sheets and second conveying means 4 for removing or advancing the stack of sheets put together. In the design shown, the sheets 1 of the blocking means 3 are fed in a shingled way lying one above the other. This means that there is a certain distance between the two front edges of two successive sheets 1. In this form, the sheets 1 may, for example, be provided by merging means also referred to as a merger which merges individual sheets cut before and arranged next to one another in a transport direction such that they are arranged lying one above the other with a slight offset in the transport direction. Merging means of this kind as such are known so that a more detailed description or illustration may be omitted.

The first and second conveying means 2 and 4 are, in the design shown, implemented as roll conveyors having transport rolls 5*a*, 5*b* and 6*a*, 6*b* which are opposite to one another and rotate in opposite directions. A respective gap 7 and 8 for the sheets 1 to be transported is formed between the transport rolls 5*a*, 5*b* and 6*a*, 6*b*. The transport rolls 5*a*, 5*b* and 6*a*, 6*b* may include, in a well-known manner, a flexible material with high friction at least at their exterior faces. The conveying means 2 and 4 may, however, also be implemented as belt conveyors or the like.

The blocking means 3 illustrated in FIG. 1 contains a rotational body 10 arranged transverse to the transport direction and rotatable around a middle axis 9, which contains four receptions 12, evenly distributed in the peripheral direction and separated from one another by lands 11, for the, in the transport direction, front edges of the sheets 1 provided by the conveying means 2. In the embodiment shown, the receptions 12 designed in the form of a groove parallel to the axis are offset from one another by 90° each in the peripheral direction of the rotational body 10. The rotational body 10 which may be rotated by a motor drive not illustrated is arranged such that its middle axis 9 is in a transport plane 13 formed between the conveying means 2 and 4. The rotational body 10 may be rotated such that, in an idle position, a respective one of the groove-shape receptions 12 is in the transport plane 13 and is oriented towards the sheets 1 provided by the conveying means 2. By rotating the rotational body 10 by a respective 90°, the next groove-shaped reception 12 may be brought to a collecting position. Rolls 14, only indicated schematically in FIG. 1, serving for pressing the sheets 1 deflected when rotating the rotational body 10 against a transport element 15 arranged below the rotational body 10 and driven by a motor are disposed at the exterior face of the lands 11. In the design shown, the transport element 15 is implemented as a transport roll. These and/or the rolls 14 may at least at their exterior faces include an elastic material having good friction characteristics so that the sheets deflected in a downward direction when turning the rotational body 10 are advanced between them, including as little backlash as possible, and guided to the second conveying means 4 arranged again in the transport plane 13 via guides not illustrated. The transport element 15 may, however, also be implemented as a belt conveyor or the like.

In the top illustration of FIG. 1, the rotational body 10 is shown in a collecting position. One of the reception grooves 12 is directed towards the conveying means 2 and arranged in the transport plane 13. The front edges of the sheets provided by the conveying means 2 are slowed down in this reception groove 12, a desired stack of sheets being formed.

As soon as the last sheet 1 of a desired stack of sheets has reached the reception groove 12, the rotational body 10 may be rotated counterclockwise by 90° by, for example, a positioning drive implemented as a stepper motor, as is illustrated in the center illustration of FIG. 1 by means of the arrow 16. The collected stack of sheets here is kept within the reception groove 12 and redirected from the transport plane 13 in a downward direction towards the transport element 15 formed as a transport roll. The stack of sheets formed is then removed between the rolls 14 of the rotational body 10 and the driven transport rolls 15.

As can be deduced from the bottom illustration of FIG. 1, at the same time as the completed collected stack of sheets is redirected, a next reception groove 12 of the rotational body 10 reaches a collecting position such that collecting the sheets for the next stack of sheets may already be started during the removal of the previous stack of sheets.

Figure 2:
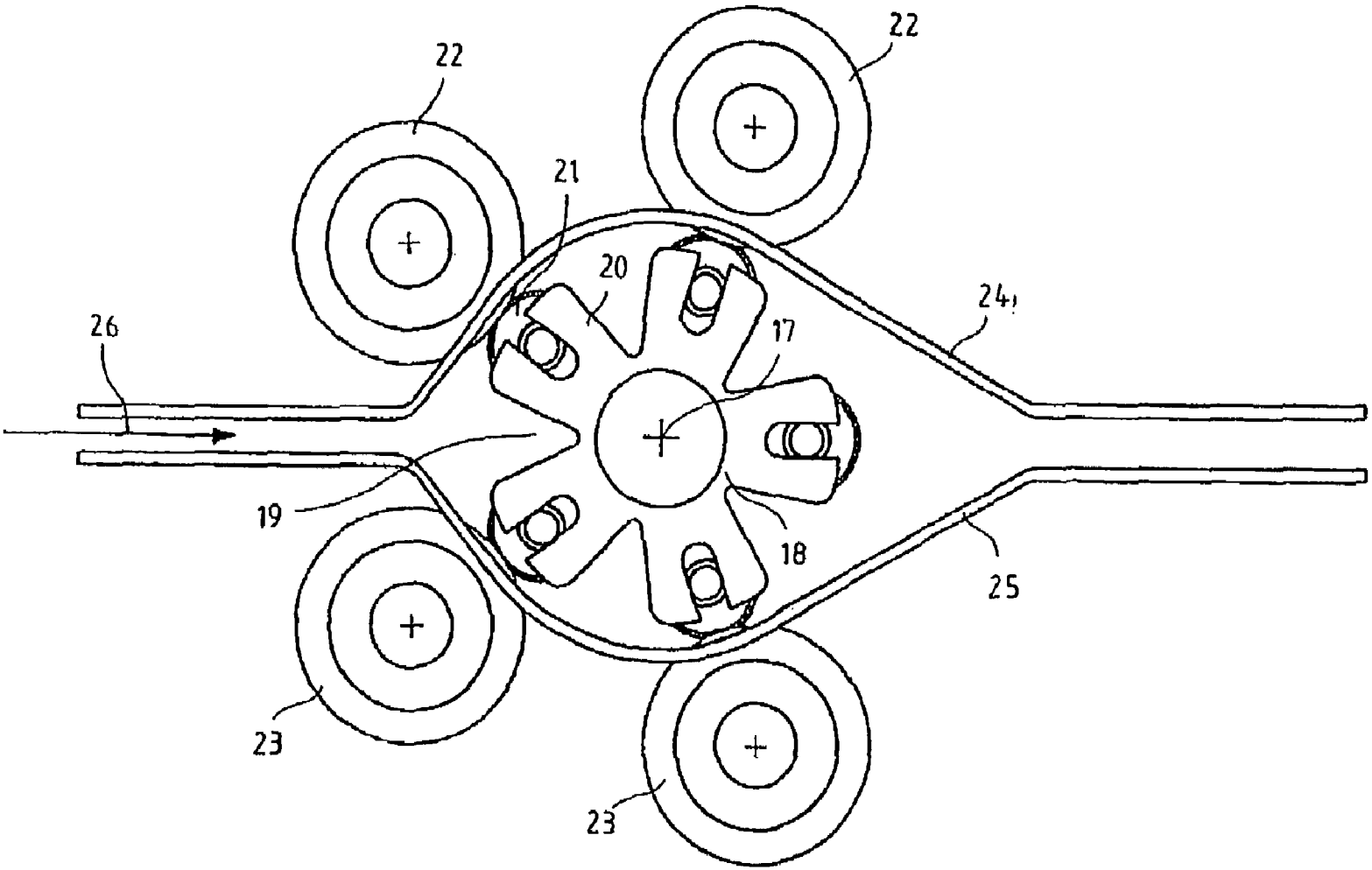
FIG. 2 shows a second embodiment of blocking means in a schematic side view.
Figure 3:
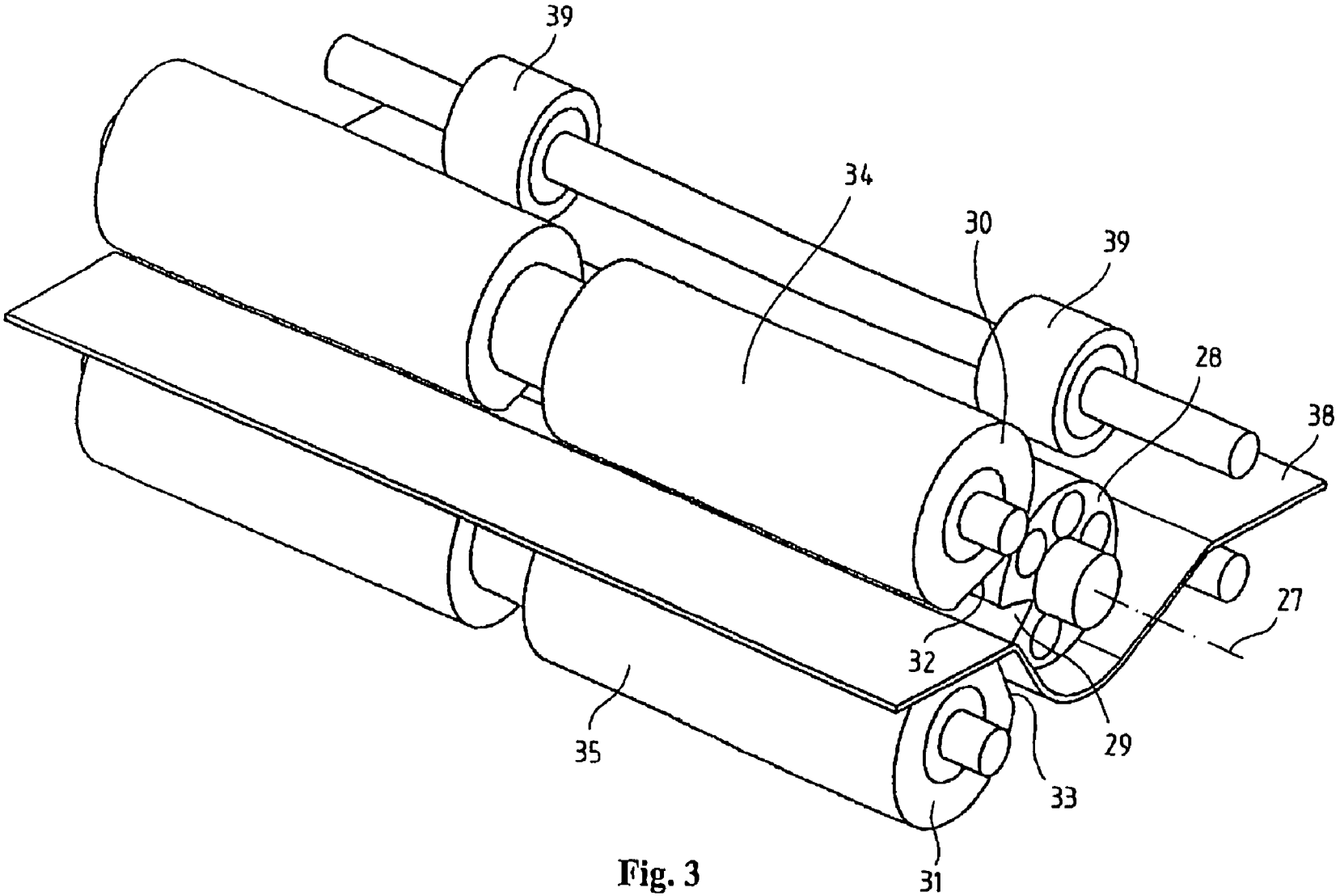
FIG. 3 shows a third embodiment of blocking means in a schematic perspective.

FIG. 2 shows, in an enlarged schematic side view, another embodiment of blocking means which is setup similarly to the blocking means of the collecting device schematically shown in FIG. 1. This blocking means, too, contains a rotational body 18 rotatable around a middle axis 17, which, in contrast to the embodiment of FIG. 1, contains five groove-shaped receptions 19 evenly distributed around the periphery of the rotational body for the front edges of the sheets. In this design, the radial receptions 19 are arranged offset to one other by 72° each in a peripheral direction and comprise a cross section increasing towards the outside. Thus, it may be ensured that the sheets fed reliably reach the reception 19. Rolls 21 movable in a radial direction and biased towards the outside by a spring or the like for pressing the sheets deflected when rotating the rotational body 18 against two transport elements 22, 23 which are arranged in an altitudinal offset to each other above and below the rotational axis 17 are provided at the lands 20 between the receptions 19. In this embodiment, too, the transport elements 22, 23 are implemented as transport rolls driven by a motor. They are arranged such that, in a collecting position, the two rolls 21 arranged above and below the rotational axis 17 contact same. In this design, the rotational body 18 is rotated by another 72° each by a suitable positioning drive for removing a certain number of sheets, wherein the sheets stopped within a reception 19 may be redirected in an upward or downward direction by turning the rotational body 18 clockwise or counterclockwise. The sheets deflected in an upward or downward direction are then at first advanced between the, in a transport direction, front and subsequently back, transport elements 22 and 23 and the transport rolls 21. The sheets are thus guided by upper and lower guiding plates 24 and 25. The transport elements 22 and 23 may be driven continuously, wherein the transport elements 22 arranged above the rotational axis 17 are, when feeding the sheets in the direction of the arrow 26, driven counterclockwise and the transport elements 23 arranged below the rotational axis 17 are driven clockwise.

In this design, too, a new stack of sheets may be collected already during removal of a previous stack of sheets. Since the rotational body may be rotated in both rotational directions and may deflect the sheets optionally in an upward or downward direction, collecting and advancing sheets shingled in an ascending and descending manner is also made possible. When the sheets transported to the collecting means are, for example, shingled in an ascending manner according to FIG. 1, the rotational body may be rotated counterclockwise, whereas the rotation is clockwise with a descending shingling.

FIGS. 3 to 6 show another embodiment of blocking means. In this embodiment, the rotational body 28 rotatable by a motor around a middle axis 27 includes a roll, arranged transverse to the transport direction, comprising only one groove-shape reception 29 in parallel to the rotational axis for the front edges of the sheets provided by conveying means. In this design, too, the reception 29 comprises a cross section increasing towards the outside. Associated to the rotational body 28 are an upper transport element 30 and a lower transport element 31. The two transport elements 30 and 31 are implemented as driven transport rolls having a lateral flattening 32 and 33 and a cylindrical exterior face 34 and 35 interrupted thereby. Also, at least at their exterior faces, the transport elements may consist of an elastic material having good friction characteristics such that a flexible gap for removing a different number of sheets may be formed between same and the rotational body 28. The drive of the transport elements 30 and 31 is tuned to the turning of the rotational body 28 such that the cylindrical exterior face 34 and 35 will only contact the exterior face 36 of the rotational body 28 when turning same. The transport elements 30 and 31 are driven in a clocked manner, wherein synchronization to the rotational body 28 may, for example, be achieved by a gear drive. The rotational body 28 in this embodiment is also surrounded by an upper and a lower guiding plate 37 and 38 for limiting a transport course with a front intake region and a back outlet region. The upper guiding plate 37 has been omitted in FIG. 3 for reasons of clarity. Conveying rolls 39 and 40 opposite to each other forming conveying means 41, downstream of the rotational body 28, for removing the collected sheets are arranged in the outlet region.

Figure 4:
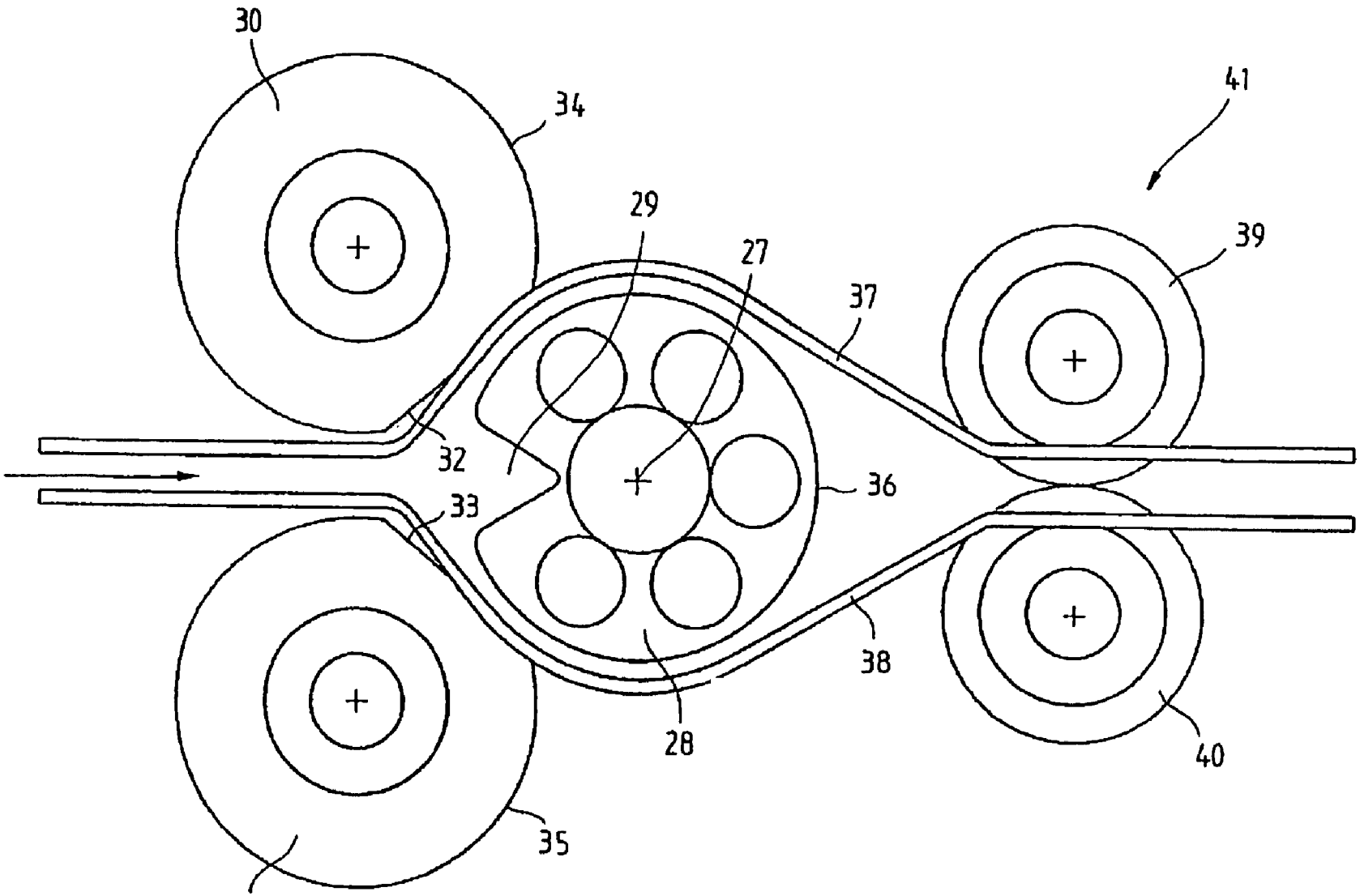
FIG. 4 is a schematic side view of the blocking means shown in FIG. 3 in a collecting position.

The turning positions of the rotational body 28 and the transport elements 30 and 31 are tuned to one another such that in the collecting position shown in FIG. 4 both flattenings 32 and 33 are directed towards the rotational body and there is no contact between the rotational body 28 and the transport elements 30 and 31.

Figure 5:
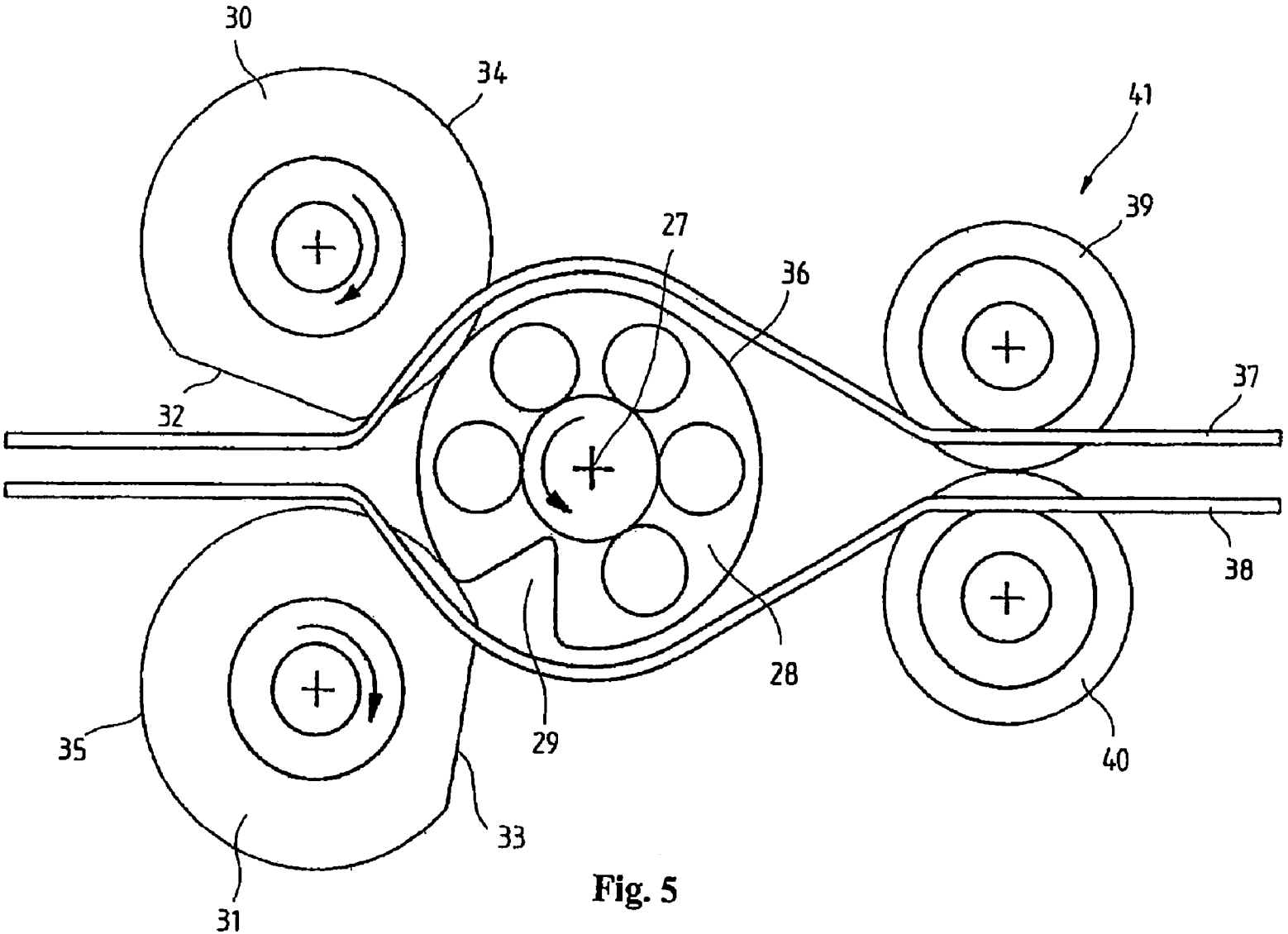
FIG. 5 is a schematic side view of the blocking means shown in FIG. 3 when starting a removal.

As soon as the front edge of the last sheet of a group to be collected has reached the reception 29, the rotational body 28 and the transport elements 30 and 31 according to FIG. 5 are turned in the direction of the arrows, wherein the cylindrical exterior faces 34 and 35 of the transport elements 30 and 31 contact the exterior face 36 of the rotational body 28. During nearly all of the rotation of the rotational body 28 by 360°, the exterior face 35 of the lower roll-shaped transport element 31 contacts its exterior face 36 such that the sheets in between are transported to the conveying rolls 39 and 40 and grasped by them to be advanced.

Figure 6:
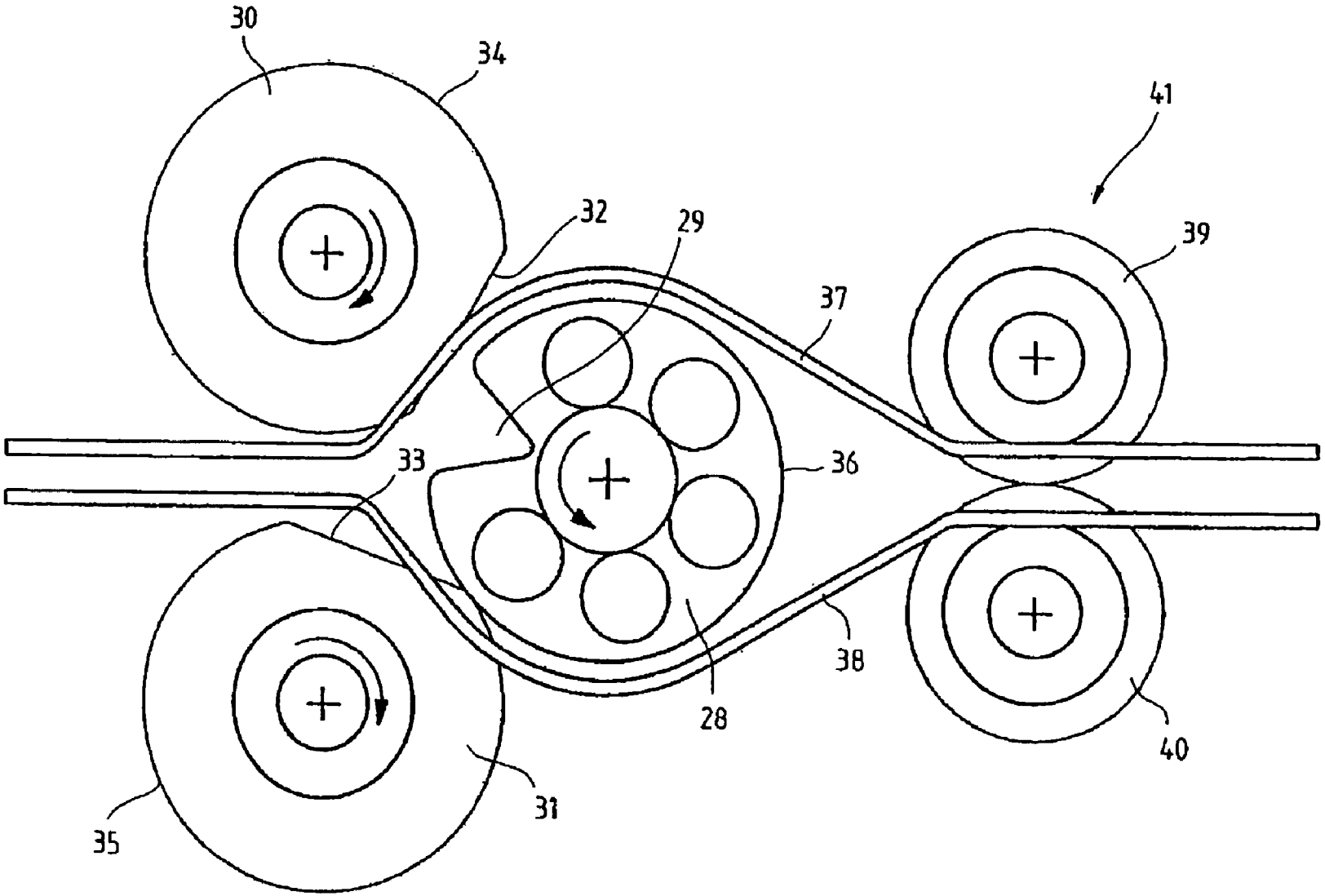
FIG. 6 is a schematic side view of the blocking means shown in FIG. 3 at the end of the removal.

When the reception 29 of the rotational body 28 has reached again the collecting position after its 360° turn, the flattenings 32 and 33 also reach the starting position again, as is illustrated in FIG. 6. The reception 29 is then available for the next collecting process. Here, too, the rotational body 28 may be rotated in a clockwise direction for deflecting the sheets in an upward direction, wherein the directions of the arrows of the transport elements 30 and 31 shown in FIGS. 5 and 6 are reversed, too.

Even with this design, sheets shingled in an ascending or descending manner may be collected and advanced without a gap to the desired stack.

The invention which has above been discussed in the connection with shingled fed individual sheets is not limited to this field of application. Instead of shingled individual sheets, individual sheets separated from one another, separated groups of several individual sheets, shingled groups or mixed groups/individual sheets may be collected and advanced to form a desired stack of sheets. Consequently, not only individual objects are to be considered as objects, but also pre-collected groups having several individual objects lying one above the other, such as, for example, groups of sheets having several individual sheets one on top of the other. Other flexible flat objects, such as, for example, customer cards, envelopes, sheet-shaped card carriers or the like, instead of sheets, may be collected to form a desired stack.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. A method for collecting flat objects, particularly sheets, fed successively in an intake plane, comprising:

stopping a certain number of objects by blocking their front edges at a blocking element arranged in a collecting position, wherein the front edges of the objects are stopped in a reception formed by a recess of a rotational body rotatable around a middle axis, the recess receiving a front part of the objects such that a rear part of the objects is outside the recess, wherein the middle axis of the rotational body and the intake plane are essentially arranged in a common plane, and wherein the recess is formed such that it is symmetrical relative to the intake plane in the collecting position of the rotational body;

initially rotating the rotational body by a predetermined rotational angle after having reached a desired collecting amount, to deflect the front edges of the objects out of the intake plane while leaving a rear part of the objects in the intake plane, engaging the front part of the collected objects deflected out of the intake plane between a transport element and a peripheral surface of the rotational body, and further rotating the rotational body for transporting the objects.

2. The method according to claim 1, wherein the objects of a subsequent group are already collected when removing the previous group.

3. The method according to claim 1, wherein the rotational body is rotated in one rotational direction for collecting objects shingled in an ascending manner and is rotated in an opposite rotational direction for collecting objects shingled in a descending manner.

4. The method according to claim 1, wherein the rotational body is driven by a servomotor.

5. A device for collecting flat objects, particularly sheets, fed successively in an intake plane, the device comprising:

a blocker comprising at least one moveable blocking element, the at least one moveable blocking element being configured to stop and subsequently release a certain number of objects fed, wherein the at least one moveable blocking element comprises a rotational body rotatable by a motor around its middle axis, the rotational body comprising a peripheral surface and at least one reception formed by a recess in the peripheral surface, the recess having a depth being smaller than a length of the objects along a feed direction and stopping the objects fed in a collection position of the rotational body, wherein a rotation of the rotational body initially causes a deflection of the front part of the objects out of the intake plane while leaving a rear part of the objects in the intake plane, at least one transport element, wherein the rotational body and the at least one transport element are arranged such that a front part of the collected objects deflected out of the intake plane is received between the at least one transport element and the peripheral surface of the rotational body and advanced when the rotational body further rotates, wherein the middle axis of the rotational body and the intake plane are essentially arranged in a common plane, wherein the recess is formed such that it is symmetrical relative to the intake plane in the collection position of the rotational body, a further transport element located downstream from the rotational body for removing the collected objects, wherein the rotational body and the at least one transport element are arranged such that the collected objects received between the at least one transport element and the peripheral surface of the rotational body are advanced to the further transport element when the rotational body rotates, wherein the transport element comprises a peripheral surface being configured to contact the peripheral surface of the rotational body only when the transport element rotates, thereby allowing removal of the collected objects by the further transport element.

6. The device of claim 5, wherein the transport element comprises a roller the peripheral surface of which comprises a flattened portion.

7. The device of claim 6, wherein the rotational body rotates by 360°.

8. A device for collecting flat objects, particularly sheets, fed successively in an intake plane, the device comprising:

a blocker comprising at least one moveable blocking element, the at least one moveable blocking element being configured to stop and subsequently release a certain number of objects fed, wherein the blocking element comprises a rotational body rotatable by a motor around its middle axis, the rotational body comprising a peripheral surface and at least one reception formed by a recess in the peripheral surface, the recess configured to receive a front part of the objects such that a rear part of the objects is outside the recess, the recess further configured to stop the objects fed in a collection position of the rotational body and for a deflection of the front part of the objects when the rotational body rotates, at least one transport element, wherein the rotational body and the at least one transport element are arranged such that the collected objects deflected are received between the at least one transport element and the peripheral surface of the rotational body and advanced when the rotational body rotates, wherein the middle axis of the rotational body and the intake plane are essentially arranged in a common plane, and wherein the recess is formed such that it is symmetrical relative to the intake plane in the collection position of the rotational body, a further transport element located downstream from the rotational body for removing the collected objects, wherein the rotational body and the at least one transport element are arranged such that the collected objects received between the at least one transport element and the peripheral surface of the rotational body are advanced to the further transport element when the rotational body rotates, and wherein the transport element comprises a peripheral surface being configured to contact the peripheral surface of the rotational body only when the transport element rotates, thereby allowing removal of the collected objects by the further transport element.

* * * * *